United States Patent [19]

Kuehnle

[11] 4,332,459

[45] Jun. 1, 1982

[54] PLATE MAKING ATTACHMENT FOR GRAPHIC ART CAMERAS

[75] Inventor: Manfred R. Kuehnle, Lexington, Mass.

[73] Assignee: Coulter Systems Corporation, Bedford, Mass.

[21] Appl. No.: 185,687

[22] Filed: Sep. 10, 1980

Related U.S. Application Data

[63] Continuation of Ser. No. 964,203, Nov. 28, 1978, abandoned, which is a continuation-in-part of Ser. No. 802,572, Jun. 1, 1977, abandoned.

[51] Int. Cl.[3] ..... G03G 15/00

[52] U.S. Cl. ..... 355/3 BE; 354/3; 355/10; 355/16; 355/77; 430/31

[58] Field of Search ..... 355/10, 16, 3 R, 3 BE, 355/77; 354/3, 275–277; 430/31, 117–119; 427/15, 30; 118/659

[56] References Cited

U.S. PATENT DOCUMENTS

| | | | |
|---|---|---|---|
| 3,084,043 | 4/1963 | Gundlach | 355/10 X |
| 3,680,955 | 8/1972 | Yata et al. | 354/3 X |
| 3,773,416 | 11/1973 | Kushima | 355/16 X |
| 3,792,924 | 2/1974 | Matsuda et al. | 355/16 X |
| 4,003,651 | 1/1977 | Hashida et al. | 355/16 |

*Primary Examiner*—Richard L. Moses

*Attorney, Agent, or Firm*—Silverman, Cass & Singer, Ltd.

[57] ABSTRACT

A printing plate making attachment for a graphic art camera taking the place of the ordinary silver halide film cartridge back. The attachment includes an endless belt of flexible electrophotograhic film that is charged by a source of corona, exposed and then rotated to a location where an ink-receptive toner in liquid form is applied to the resulting latent image under bias conditions. A supply of plate material such as paper, aluminum, plastic or other flexible substrate material is included and a single sheet of the plate material is fed into the nip of a pressure roller engaging against the endless belt, causing the toned image to be transferred from the belt to the plate material. The plate material containing the toned image is then fed past a fixing station and thereafter dispensed as a completed plate. The plate is suitable for us in an offset printing press.

36 Claims, 2 Drawing Figures

PLATE MAKING ATTACHMENT FOR GRAPHIC ART CAMERAS

REFERENCE TO PRIOR APPLICATION

This application is a Continuation of Pat. application Ser. No. 964,203 filed Nov. 28, 1978 which is in turn a continuation-in-part of Ser. No. 802,572 filed June 1, 1977 both now abandoned.

FIELD AND BACKGROUND OF THE INVENTION

The field of this invention is the art of making offset printing plates for use in printing through the use of electrophotographic techniques.

Offset plates are normally made photographically by complex methods requiring the use of silver halide film, photoresists, and the processing of the images to achieve their incorporation onto plates that can be used in printing presses. In recent years electrostatic techniques have also been used to make such plates but their quality is so inferior to the quality of photographically made plates that not much of this type of technique is used.

The invention herein revolves around a type of electrophotographic film that is capable of being imaged with quality and gray scale as good as if not better than that achieved by photographic techniques and with resolution that is better. The film comprises a photoconductive coating that is bonded onto a conductive substrate. The photoconductive coating may comprise radio frequency sputtered cadmium sulfide that is preferably from about 200 Angstroms to about 2 microns thick. The conductive substrate may comprise a layer of indium tin oxide about 300 to 500 Angstroms thick which is bonded to a sheet of stable polyester plastic about 0.005 inch thick. One such film is described in U.S. Pat. No. 4,025,339 issued May 24, 1977.

Because of the fact that the electrophotographic film can be exposed at high speed and transferred immediately to a plate of material such as paper, aluminum, plastic and the like, the process can be carried on inside of a cartridge that takes the place of the usual photographic film cartridge that is used with graphic arts cameras. This is convenient and eliminates considerable processing since the resulting plate made by the device is suitable for use in an offset printing press. If the plate material is plain paper, no further processing is needed since plain paper is of a hydrophyllic nature. If the plate material is other than plain paper, additional processing may be required to make the untoned portions hydrophyllic.

SUMMARY OF THE INVENTION

A printing plate making attachment for a graphic art camera taking the place of the ordinary silver halide film cartridge back. The attachment includes an endless belt of flexible electrophotographic film that is charged by a source of corona, exposed and then rotated to a location where an ink-receptive toner in liquid form is applied to the resulting latent image under bias conditions. A supply of plate material such as paper, aluminum, plastic or other flexible substrate material is included and a single sheet of the plate material is fed into the nip of a pressure roller engaging against the endless belt, causing the toned image to be transferred from the belt to the plate material. The plate material containing the toned image is then fed past a fixing station and thereafter dispensed as a completed plate. The plate is suitable for us in an offset printing press.

DESCRIPTION OF THE PREFERRED EMBODIMENT

Offset printing plates are made by a technique which requires that the image to be incorporated into the plate finish be photographed. The cameras which are used for this purpose are called graphic arts cameras. These cameras normally include a plate of silver halide film contained in a cartridge that is removably attached to the back of the camera at the focal plane thereof.

Figure 1:
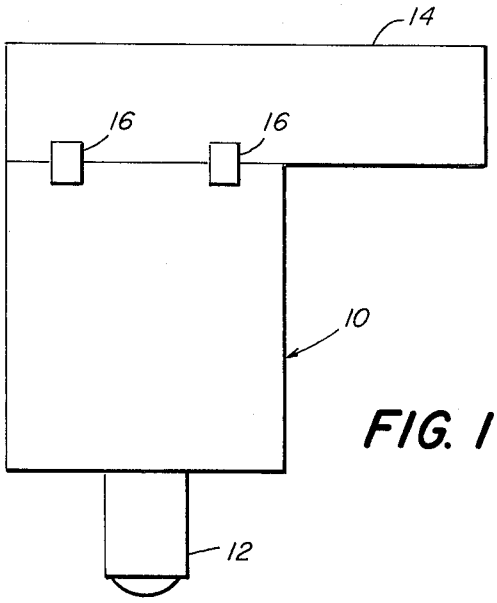
FIG. 1 is a block diagram showing the attachment of the invention connected to the back of a graphic arts camera.

In FIG. 1 there is shown a graphic arts camera 10 incorporating the attachment of this invention. The camera 10 includes a housing 11, a lens system 12 and a copyboard 13. An attachment 14 constructed according to this invention is connected to the back of camera 10 by brackets 16.

Figure 2:
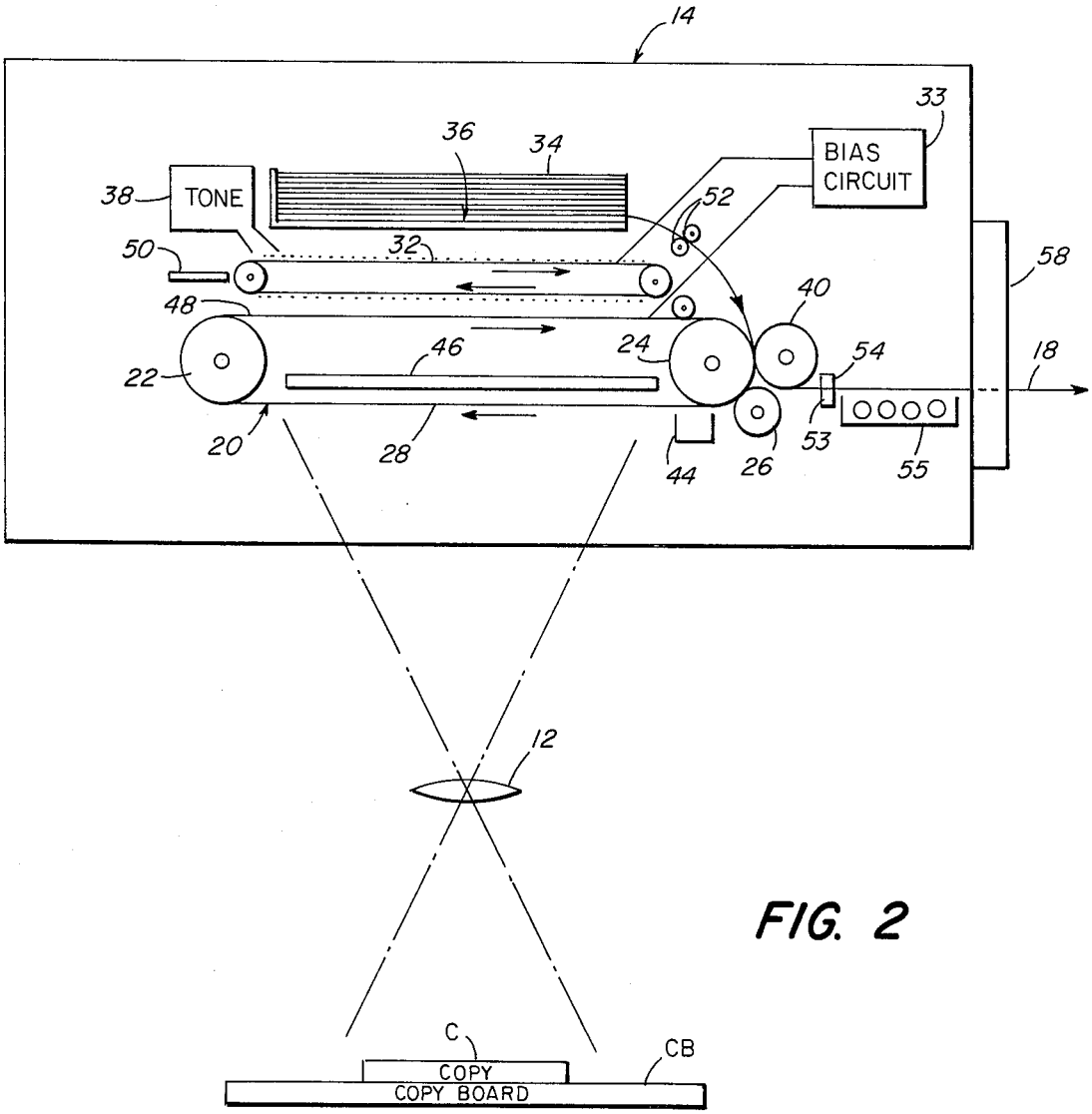
FIG. 2 is a diagram of the attachment showing the basic parts and construction thereof.

On its interior, as can be seen in FIG. 2, attachment 14 is shown to contain an endless electrophotographic film belt 20 mounted on drive and/or mounting rollers 22 and 24. A drive roller 26 may be utilized in addition to mounting rollers 22 and 24. Belt 20 has a bottom planar reach 28 which, as is shown, is facing lens 12 and positioned so that when the camera is used to image copy, the image will be projected onto the outer surface of the belt on the bottom thereof. Attachment 14 also contains a toner and bias belt 32, a supply of plate material 34 mounted on a suitable support 36, a liquid toner supply and dispensing means 38, a pressure roller 40 and a fixing station at 42. Various guide and drive rollers, controls, electrical connections and the like are required but not shown since, as will be explained, when the invention is described these will become apparent to those skilled in this art.

There is a corona generating device 44 including a corona wire which may be fixed or oscillating to provide an even distribution of charge when the attachment is in operation.

When it is desired to use camera 10 and the attachment 14, camera 10 is focussed on the copy C, the copy C is suitably illuminated by lights (not shown) and the cycle of operation is started by any suitable switch. The sequence of operation is readily programmed by switching and logic circuits that are readily constructed and incorporated into the attachment.

The first thing that happens is that belt 20 is driven in a generally clockwise direction by the drive roller 26 or other drive means for a period of time that is required to carry a portion of the length thereof past the corona device 44 and onto the bottom of the belt to form a first planar reach 28 along substantially the entire length thereof. The corona device 44 has in the meantime been energized and it charges the photoconductive coating of the film forming the belt 20. The direction of movement is shown by the arrows.

Ideally the charge of the belt 20 is controlled by suitably controlling the corona voltage and/or the speed of the belt 20. The surface voltage may be measured by an electrostatic voltmeter and related to the amount of exposure that is to be made.

Once the charged length of the film of the belt 20 has been positioned to form the first planar reach 28, belt 20 is stopped in its movement and rigidly held with first planar reach 28 exactly aligned in the focal plane of lens system 12 by means of a vacuum platen 46. Suitable means to operate platen 46 are provided and are not shown. The vacuum platen 46 sucks the first planar reach 28 of belt 20 flatly against itself and holds the bottom surface exactly in the focal plane until the exposure has been made. This, like the other functions of the attachment 14 can be worked into an automatic program or can be performed in a sequence manually by the operator.

With belt 20 fixed, the camera shutter (not shown) is now operated to expose the film reach 28 to the projected light image of the copy C being reproduced. It is understood that the entire attachment 14 is in darkness.

After exposure, belt 20 is released from platen 46 by applying air pressure thereto and the belt drive operated by the roller 26 to move belt 20 in the same clockwise direction for a period of time which will carry the now-exposed bottom section up and onto the top of the belt to a second planar reach. Here belt 20 stops moving once more.

Now the toning and bias belt 32 is started up and rotates in a clockwise direction, as shown by the arrows. This movement is relatively rapid in order to dispense ink-receptive liquid toner onto the second planar reach 48 of belt 20 which is positioned so as to be in a plane that is parallel to the first planar reach 28. The toner need not be visible but must be ink-receptive. Since belt 32 is rotated in a clockwise direction, the toner will be applied along belt 20 in the same order in which belt 20 is charged by corona device 44. Suitable dams and absorbant confining member are provided (not shown) to prevent the toner from running off the edges and end of the areas which it is desired to tone. Toner is dispensed onto toning and bias belt 32 from toner supply 38. The belt 32 is formed of conductive material such as metal and a bias of about 2–20 volts d.c. plus is established between the two belts in the gap between them by a bias circuit 33, the film belt 20 being positive relative to the toning belt 32. After a period of time has elapsed when there has been sufficient adherence of the toner particles, there is a voltage applied to the two belts across the gap of the order of negative 200 volts d.c. on the toner belt relative to the film belt 20 so that there is a sweeping of the uncommitted toner particles from the toned image.

The gap between the belts is of the order of capillary dimensions to enable the handling of the liquid toner. The belt 32 is squeegeed dry by a suitable doctor blade 50 located at the left end thereof as viewed in FIG. 2.

After the image on belt 20 has been toned, that is, developed, belt 20 commences to move again, this time carrying the image to the right and into the nip between rollers 24 and 40. In the meantime a sheet of plate material 34 which can be metal, paper or plastic, has been led through the feed rollers 52 also to the nip between rollers 24 and 40 and is being pressed against or brought into close proximity with the surface of the belt 20 as the belt rotates. The toned image which is still moist is transferred to the sheet of plate material 34 and emerges at the right of rollers 24 and 40. Suitable guide and confining means 53 and 54 ensure this movement.

There will preferably be a transfer voltage of approximately negative 400 volts d.c. applied to the transfer roller 40 to move the toned image onto the sheet of plate material 34.

After the sheet of plate material 34 emerges from the transfer means defined by rollers 24 and 40 it is passed over a fixing station 55 of heat lamps or the like where the toner is fused to the sheet. This completes the making of the plate which emerges at opening 18 from the attachment 16. If the plate material is hydrophyllic, the sheet is ready for use in an offset printing press without further processing. If the plate material is not hydrophyllic, the sheet must be suitably treated so as to make the untoned portion hydrophyllic before it can be used in an offset printing press. For example, if the plate material is aluminum, the sheet is immersed in a bath of phosphoric acid and gum arabic and is then ready for direct use.

The supply of plate material 34 as shown is in the form of a stack of sheets; however, it may also be in the form of a continuous strip mounted on a reel and means are in such case provided to cut off the portion which has been processed as it emerges at 18. Such cutoff means are indicated generally by the block 58.

The belt 20 may also be an endless web containing only a portion of film substantially equal to the reach 28. The fixing of the toner may be done outside of the attachment 14. The corona device 44 may be energized after the belt is stopped in the reach 28 and the device 44 may be moved past the stopped film to apply the charge.

Variations and modifications are capable of being made without departing from the spirit or scope of the invention as defined in the appended claims.

What it is desired to secure by Letters Patent of the United States is:

1. A printing plate making attachment for coupling as a unit to a graphic art camera of the type having structure for projecting a light image to a planar image plane at the rear of the camera and exposing such plane to such image for a predetermined period of time, the attachment comprising:

a. means for securing the attachment as a unit to the camera at the rear of the camera;

b. a rotatable endless electrophotographic belt comprising at least an outwardly facing electrophotographic surface portion formed as a part thereof for directly receiving the light image, said belt having a first planar reach disposed parallel generally proximate to the image plane of the camera and a second reach generally parallel to said first planar reach and having a terminal end;

c. means for controlled rotation of the belt through an operating cycle consisting of charging, exposure, toning, transfer of the toned image and cleaning if necessary;

d. means at a first location along said first reach proximate the commencement of said first reach for charging the electrophotographic surface portion;

e. platen means between said reaches and located along said first reach at a second location therealong and having a surface exactly in the image plane conforming thereto and having means operating accurately to dispose the electrophotographic surface portion of the belt exactly in said image plane, said means operating further to hold said electrophotographic surface portion securely in said image plane during exposure and means associated with said platen means positively to force said belt from said platen surface whereby to permit subsequent rotation of the belt through said first and second reaches, whereby a latent image produced on the electrophotographic surface portion at the second location along said first reach is thereafter carried toward said second reach for toning the latent image for subsequent transfer from the electrophotographic surface portion;

f. toner supply and dispensing means for applying toner to the latent image on the electrophotographic surface portion at a third location downstream of the second location at least subsequent to the first reach; and g. transfer means at the terminus of the second reach for bringing a sheet of plate material from a source into at least close proximity with said toned image on the electrophotographic surface portion to transfer said toned image to said sheet of plate material.

2. The attachment as claimed in claim 1 in which the toner is in liquid form.

3. The attachment as claimed in claim 1 in which the toner dispensing means include a second endless belt having a top reach and a bottom reach, the toner supply being arranged to apply toner to the top reach of the second endless belt, the bottom reach of the second endless belt being juxtaposed to the second reach of the electrophotographic belt and adapted to move parallel relative thereto, the toner being applied to the top reach of the second endless belt around to the bottom reach thereof and thereafter dispensed onto the second reach of the electrophotographic belt to tone a latent image carried on the electrophotographic surface portion thereof.

4. The attachment as claimed in claim 3 in which the toner is in liquid form.

5. The attachment as claimed in claim 3 in which means are provided electrically to bias the said belts relative to one another across the space between belts to assist in the toning operation.

6. The attachment as claimed in claim 4 in which means are provided electrically to bias said the belts relative to one another across the space between belts to assist in the toning operation.

7. The attachment as claimed in claim 5 in which said bias means include structure for applying a low voltage bias at the beginning of a toning period and a higher bias at the end of such period to clear any floating toner particles from said electrophotographic surface portion subsequent to completion of toning of the said latent image carried thereby.

8. The attachment as claimed in claim 1 in which said operating means comprise vacuum means associated with said platen means to draw said belt flat against said surface of said platen means with the outwardly facing electrophotographic surface portion in said image plane.

9. The attachment as claimed in claim 3 in which means are provided to squeegee toner from said second endless belt as it rotates.

10. The attachment as claimed in claim 4 in which means are provided to remove toner from the second endless belt as it rotates and prior to entry thereof to its top reach.

11. The attachment as claimed in claim 1 and further including a supply of plate material and wherein the transfer means includes transfer roll means engaged against the electrophotographic surface portion and providing a nip between itself and said surface portion and means for leading said carrier material into the nip as said toned surface portion is rotated by the roll means to transfer said image.

12. The attachment as claimed in claim 1 and further including means for fixing the transferred image on said plate material.

13. The attachment as claimed in claim 1 in which means are provided electrically to bias the plate material relative to said electrophotographic surface portion to assist in the transfer operation.

14. The attachment as claimed in claim 1 wherein means for leading the carrier material with the transferred image therein out of said attachment are provided adjacent the transfer means to receive said carrier material therefrom.

15. A printing plate making attachment for use operably coupled as a unit to a graphic art camera that has structure for projecting a light image to an image plane at the rear of the camera and exposing such plane to such image for a predetermined period of time, said attachment comprising:

a. a rotatable endless electrophotographic belt comprising an outwardly facing electrophotographic portion having film and defining a first planar reach and proximate the image plane and a second planar reach disposed in a plane generally parallel to the first planar reach and juxtaposed thereover;

b. means for controlled rotation of the endless belt through one full revolution for completion of one cycle at least including charging, toning and transfer for each full revolution;

c. means proximate said first reach for charging said electrophotographic surface portion;

d. platen means disposed along the first reach between said reaches and having a surface exactly in the image plane conforming thereto and having means accurately to locate the electrophotographic surface portion at a location along said first reach exactly in the image plane and to hold the said surface portion at said location securely in said plane for exposure, said platen means further including means positively urging said endless belt from said plane after exposure is completed to permit subsequent rotation of said belt with same carrying a latent image carried by said electrophotographic surface portion toward the second reach;

e. toner supply and dispensing means for applying toner to the surface portion after it passes through the first reach toward the said second reach for toning the latent image for subsequent transfer from the belt; and f. transfer means for bringing plate material from a supply into close proximity with said toned image on the electrophotographic surface portion at a location at the terminal end of the second reach subsequent to the location whereat toner is applied whereby transfer of the toned image to said plate material is effected.

16. The attachment as claimed in claim 15 in which the toner is in liquid form.

17. The attachment as claimed in claim 16 in which the toner dispensing means include a second endless belt having a top reach and a bottom reach, the toner supply being arranged to apply toner to the top reach of the second endless belt, the bottom reach of the second endless belt being juxtaposed to the second reach of the electrophotographic belt and adapted to move in a parallel plane relative thereto, the toner being carried on the top reach of the second endless belt around to the bottom reach thereof and thereafter dropped upon the upwardly facing electrophotographic surface portion of the electrophotographic belt to tone the latent image carried thereon as said respective reaches pass each other.

18. The attachment as claimed in claim 15 in which the toner is in liquid form.

19. The attachment as claimed in claim 18 in which means are provided electrically to bias said belts relative to one another across the space between belts to assist in the toning operation.

20. The attachment as claimed in claim 19 in which means are provided electrically to bias the belts relative to one another across the space between belts to assist in the toning operation.

21. The attachment as claimed in claim 20 in which said bias means include structure for applying a low voltage bias at the beginning of a toning period and a higher bias at the end of such period to clear any floating toner particles from said electrophotographic surface portion subsequent to the completion of toning at the end of said toning period.

22. The attachment as claimed in claim 15 in which the means includes vacuum means to draw said electrophotographic portion flat against said bottom planar surface.

23. The attachment as claimed in claim 19 in which means are provided to remove toner from the second endless belt as it rotates and prior to entry thereof to its top reach.

24. The attachment as claimed in claim 16 in which the transfer means include transfer roll means engaged against the electrophotographic surface portion providing a nip between itself and said surface portion and means for leading a sheet of plate material into the nip as said electrophotographic surface portion is rotated through said one revolution.

25. The attachment as claimed in claim 16 and further including means for fixing a transferred image on said carrier material before it is led out of the attachment.

26. The attachment as claimed in claim 16 in which means are provided electrically to bias said carrier material relative to said electrophotographic surface portion.

27. The attachment as claimed in claim 16 wherein means for leading the plate material with the transferred image thereon out of said attachment are provided adjacent the transfer means to receive said plate material therefrom.

28. A method of making an ink-receptive image on a sheet of plate material, which sheet of plate material may subsequently be suitable for use as a printing plate, using a graphic arts camera and a rotatably mounted endless electrophotographic belt defining a pair of juxtaposed parallel reaches and the belt having an outwardly facing electrophotographic surface portion as a part thereof comprising:

a. rotating the electrophotographic surface portion through one revolution along a pair of planar parallel reaches past a series of locations;

b. charging the electrophotographic surface portion at a first location near the commencement of the first reach;

c. positioning the belt with the electrophotographic surface portion at a second location along the first reach at least in the vicinity of closely proximate the image plane of the camera;

d. stopping the rotation of the belt at said second location;

e. forcing the electrophotographic surface portion exactly into the image plane of the camera at said second location;

f. exposing the electrophotographic surface portion to the copy to be imaged while said surface portion is exactly in the image plane to produce a latent image of said copy on said electrophotographic surface portion thereat;

g. forcing the electrophotographic surface portion from the image plane;

h. rotating said belt with the electrophotographic surface portion to a third location spaced from the second location wherein the electrophotographic surface portion is in a plane along a reach generally parallel to the image plane;

i. applying toner to the electrophotographic surface portion while it is at the third location;

j. rotating the resulting toned electrophotographic surface portion to a fourth location;

k. transferring the resulting toned image from the electrophotographic surface portion to a sheet of plate material at said fourth location; and l. fixing the toned image to the sheet of plate material.

29. A method as claimed in claim 28 wherein said toning includes:

arranging an endless belt having a pair of generally parallel superposed spaced reaches proximate the first endless belt and a bottom reach substantially parallel to the electrophotographic surface portion and applying the toner to the top of the upper one of said second endless belt reaches, rotating said second endless belt so that the applied toner is carried to the parallel bottom reach and from there directing the toner to the said electrophotographic surface portion.

30. A method as claimed in claim 29 wherein said toning includes:

electrically biasing the first and second endless belts relative to one another at said third location.

31. A method as claimed in claim 30 wherein said toning includes:

applying a low voltage bias between the first and second endless belts following said first period of time, said bias being applied at the third location.

32. A method as claimed in claim 30 wherein said toning includes:

removing said toner from said second belt before it rotates from its bottom reach.

33. A method as claimed in claim 29 wherein the step of securing said surface portion at the second location is effected by:

applying a negative pressure to one side of said belt surface portion across the image plane to draw said electrophotographic surface portion into said image plane and applying air pressure against said belt to release the electrophotographic surface from said image plane.

34. A method as claimed in claim 29 wherein said transferring includes:

rolling said plate material against said electrophotographic surface portion.

35. A method as claimed in claim 29 wherein said transferring includes:

electrically biasing said plate material relative to said film portion.

36. The method as claimed in claim 29 and the further steps of stopping the electrophotographic surface portion at said third location and applying said toner thereto while the said surface portion is stopped at said third location.

* * * * *